US006932630B2

(12) United States Patent
Taga

(10) Patent No.: US 6,932,630 B2
(45) Date of Patent: Aug. 23, 2005

(54) CONNECTOR EQUIPPED WITH DUST-PROOF ARRANGEMENT, AND A SET OF DUST-PROOF HOODS FOR CONNECTOR

(75) Inventor: Atsushi Taga, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/027,947

(22) Filed: Jan. 4, 2005

(65) Prior Publication Data

US 2005/0112937 A1 May 26, 2005

Related U.S. Application Data

(62) Division of application No. 10/387,838, filed on Mar. 14, 2003, now Pat. No. 6,854,991.

(30) Foreign Application Priority Data

Mar. 15, 2002 (JP) ..... 2002-072378

(51) Int. Cl.[7] ..... H01R 13/44
(52) U.S. Cl. ..... 439/138
(58) Field of Search ..... 439/138, 136, 439/142, 135

(56) References Cited

U.S. PATENT DOCUMENTS 6,135,802 A 10/2000 Nakamura

FOREIGN PATENT DOCUMENTS

| | | |
|---|---|---|
| CN | 1208974 A | 2/1999 |
| JP | 62-290081 | 12/1987 |
| JP | 63-134480 | 9/1988 |
| JP | 63-134481 | 9/1988 |
| JP | 9-81699 | 3/1997 |
| JP | 11-067331 | 3/1999 |
| JP | 11-86953 | 3/1999 |

OTHER PUBLICATIONS

Copy of The People's Republic of China Office Action dated Dec. 31, 2004 (and English translation of same) 03120452.X.

*Primary Examiner*—Javaid H. Nasri
(74) *Attorney, Agent, or Firm*—Dickstein, Shapiro, Morin & Oshinsky, LLP.

(57) ABSTRACT

In a dust-proof connector for an electronic unit detachably provided in an electronic apparatus in which an air-stream is produced in the apparatus to cool an interior thereof, the connector includes a first type connector half provided on the electronic unit and having a first array of electrical contacts, and a second type connector half provided in the apparatus and having a second array of electrical contacts. First and second dust-proof hoods are associated with the first and second connector half, and are formed of a suitable elastic material. The first hood is configured to block off the air-stream to thereby protect the first array from penetration of dust in the air-stream, and the second hood is configured to block off the air-stream to thereby protect the second array from penetration of dust in the air-stream. The first and second hoods cooperate with each other to be elastically deformed so as not to hinder establishment of a connection between the first and second arrays when the connector halves are connected to each other.

9 Claims, 13 Drawing Sheets

CONNECTOR EQUIPPED WITH DUST-PROOF ARRANGEMENT, AND A SET OF DUST-PROOF HOODS FOR CONNECTOR

CROSS REFERENCE TO RELATED APPLICATIONS

This application is a Divisional application of U.S. patent application Ser. No. 10/387,838 filed Mar. 14, 2003 now U.S. Pat. No. 6,854,991, which claims priority to Japanese Patent Application No. 2002-072378, filed Mar. 15, 2002. The contents of all of these applications are hereby incorporated by reference herein.

BACKGROUND OF THE INVENTION

1. Field of the Invention

The present invention relates to a connector for an electronic unit detachably provided in an electronic apparatus, such as a computer, a work station or the like, to transmit signals between the electronic unit and the electronic apparatus, and more particularly relates to such a connector equipped with a dust-proof arrangement.

Also, the present invention relates to a set of dust-proof hoods for an existing connector including a male type connector half and a female type connector half.

2. Description of the Related Art

As the electronic unit detachably provided in the electronic apparatus, there are a hard disk drive unit, a wiring-board unit having various electronic components mounted thereon, and so on. These electronic units are detachably connected to a motherboard provided in the electronic apparatus. For example, in order to detachably connect the hard disk drive unit to the motherboard, a connector including a pair of connector halves is used. One of the connector halves is formed as a female type connector half, and the other connector half is formed as a male type connector half. Usually, the female type connector half is securely attached to the motherboard, and the male type connector half is securely attached to the hard disk drive unit.

On the other hand, the electronic apparatus is provided with a fan for cooling an interior of the electronic apparatus. Namely, external air containing dust is introduced into the interior of the electronic apparatus to thereby produce air-streams therein, and the introduced air is finally discharged from the electronic apparatus. Thus, while the electronic apparatus is operated over a long time, the dust is gradually deposited on interior structures of the electronic apparatus and various electronic parts mounted on the motherboard.

For example, when the hard disk drive unit becomes inoperative, the male type connector half of the hard disk drive unit is frequently disconnected from the female type connector half of the motherboard under the operational condition of the electronic apparatus, to replace a new hard disk drive unit for the inoperative unit.

During the replacement, the deposited dust is liable to be disturbed, and the thus disturbed dust is taken up by the air-streams produced in the interior of the electronic apparatus. When a part of the air-streams is directed to the female type connector half, the dust penetrates into electrical sheath-like contacts of the female type connector half. Accordingly, when the male type half connector of the new hard disk drive unit is connected to the male type connector half of the motherboard, there may be a case where electrical connections cannot be completely established between the connector halves.

Also, in the case of an electronic apparatus which is constituted such that an additional hard disk drive unit can be utilized, if necessary, a motherboard of the electronic apparatus is provided with only a female type connector half, and the additional hard disk drive unit is connected to the female type connector half through a male type connector half thereof when needed later. Thus, the female type connector half must be protected from dust in air-streams in the electronic apparatus, before electrical connections can be securely established between the connector halves.

Conventionally, there are various types of dust-proof connectors as disclosed in, for example, Japanese Laid-Open Patent Publications (KOKAI) No. SHO-62-290081, HEI-09-081699, and HEI-11-086953, and Japanese Laid-Open Utility Model Publications (KOKAI) No. SHO-63-134480 and No. SHO-63-134481. Nevertheless, these prior art references fail to disclose a dust-proof connector in which dust in air-streams is taken into consideration.

SUMMARY OF THE INVENTION

Therefore, an object of the present invention is to provide a connector with a dust-proof arrangement, which is provided in an electronic apparatus, such as a computer, a work station or the like, to transmit signals between the electronic unit and the electronic apparatus, wherein the dust-proof arrangement is constituted such that the connector is protected from dust in air-streams produced in the electronic apparatus.

Also, another object of the present invention is to provide a set of dust-proof hoods to be used in an existing connector including a male type connector half and a female type connector half, to protect the connector from dust in air-streams.

In accordance with a first aspect of the present invention, there is provided a dust-proof connector for an electronic unit detachably provided in an electronic apparatus in which an air-stream is produced in the electronic apparatus to cool an interior thereof. The connector includes a first type connector half provided on the electronic unit and having a first array of electrical contacts, and a first dust-proof hood associated with the first type connector half and formed of a suitable elastic material. The first dust-proof hood is configured so as to block off the air-stream to thereby protect the first array of electrical contacts from penetration of dust in the air-stream. The connector further includes a second type connector half provided in the electronic apparatus and having a second array of electrical contacts, and a second dust-proof hood associated with the second type connector half and formed of a suitable elastic material. The second dust-proof hood is configured so as to block off the air-stream to thereby protect the second array of electrical contacts from penetration of dust in the air-stream. The first and second dust-proof hoods cooperate with each other to be elastically deformed so as not to hinder establishment of a connection between the first array of electrical contacts and the second array of electrical contacts when the first type connector half and the second type connector half are connected to each other.

In accordance with a second aspect of the present invention, there is provided a set of first and second dust-proof hoods for a connector including a first type connector half having a first array of electrical contacts, and a second type connector half having a second array of electrical contacts. The connector is utilized in an electronic unit detachably provided in an electronic apparatus in which an air-stream is produced in the electronic apparatus to cool an interior thereof. The first dust-proof hood is adapted to be attached to the first type connector half to protect the first array of electrical contacts from dust in the air-stream, and the second dust-proof hood being adapted to be attached to the second type connector half to protect the second array of electrical contacts from dust in the air-stream. The first and second dust-proof hoods cooperate with each other to be elastically deformed so as not to hinder establishment of a connection between the first array of electrical contacts and the second array of electrical contacts when the first type connector half and the second type connector half are connected to each other.

In the second aspect of the present invention, each of the first and second dust-proof hoods may have an adhesive layer for the attachment to a corresponding connector half. Preferably, a peel-off sheet is applied to the adhesive layer.

In the first and second aspects of the present invention, when the air-stream is produced along a direction parallel to a connecting direction in which the first type connector half and the second type connector half are connected to each other, each of the first and second dust-proof hoods is formed as a bent plate-like member including a section extended in parallel to the connecting direction, and a slant section directed toward a corresponding array of electrical contacts to define an acute angle between the sections, whereby the corresponding array of electrical contacts is covered and concealed with the slant section, resulting in the protection of the corresponding array of electrical contacts from the penetration of dust in the air-stream.

Also, when the air-stream is produced along a direction perpendicular to a connecting direction in which the first type connector half and the second type connector half are connected to each other, each of the first and second dust-proof hoods is formed as a bent plate-like member including a section extended perpendicular to the connecting direction, and a slant section directed to define an obtuse angle between the sections, thereby blocking the air-stream, resulting in the protection of the corresponding array of electrical contacts from the penetration of dust in the air-stream.

Each of the first and second dust-proof hoods may be made of a suitable rubber material. Preferably, each of the first and second dust-proof hoods is made of a suitable electrically conductive rubber material, and is grounded to an electrically conductive frame of the electronic apparatus.

Also, each of the first and second dust-proof hoods may made of a suitable transparent elastic resin material. When each of the first and second dust-proof hoods is made of a suitable elastic resin material, it is preferably provided with an electrically conductive film layer formed thereon, and the electrically conductive film layer is grounded to an electrically conductive frame of the electronic apparatus.

In accordance with a third aspect of the present invention, there is a connector half including an array of electrical contacts, and a dust-proof hood made of an elastic material and attached to a body of the connector half, the hood being extended so as to shield the array of electrical contacts from dust.

In the third aspect of the present invention, the dust-proof hood may have an end fixed to the body of the connector half, and a free end extended to a front face of the array of electrical. Preferably, the dust-proof hood may be constituted so as to prevent penetration of dust in an air-stream produced at a place at which the connector half is to be connected to and disconnected from another connector half. Also, the dust-proof hood is elastically deformable so as not to hinder a connection of the connector half to another connector half.

When each electrical contact is formed as a male type contact, the body of the connector half may be a connector housing which surrounds the array of male type contacts. Also, when each electrical contact is formed as a female type contact, the body of the connector half may be a plug member in which the array of female type contacts is provided.

In the third aspect of the present invention, the dust-proof hood may be made of a suitable rubber material. Preferably, the dust-proof hood is made of a suitable electrically conductive rubber material, and is grounded.

Also, the dust-proof hood may be made of a suitable transparent elastic resin material. When the dust-proof hood is made of a suitable elastic resin material, it is preferably provided with an electrically conductive film layer formed thereon, and the electrically conductive film layer is grounded.

BRIEF DESCRIPTION OF THE DRAWINGS

The above objects and other objects will be more clearly understood from the description set forth below, with reference to the accompanying drawings, wherein:

FIG. 1B is a perspective view showing a female type connector half forming the other part of the first embodiment of the connector equipped with the dust-proof arrangement according to the present invention, the female type connector half being securely attached to a motherboard provided in an electronic apparatus, such as a computer, a work station or the like;

DESCRIPTION OF THE PREFERRED EMBODIMENTS

Figure 1A:
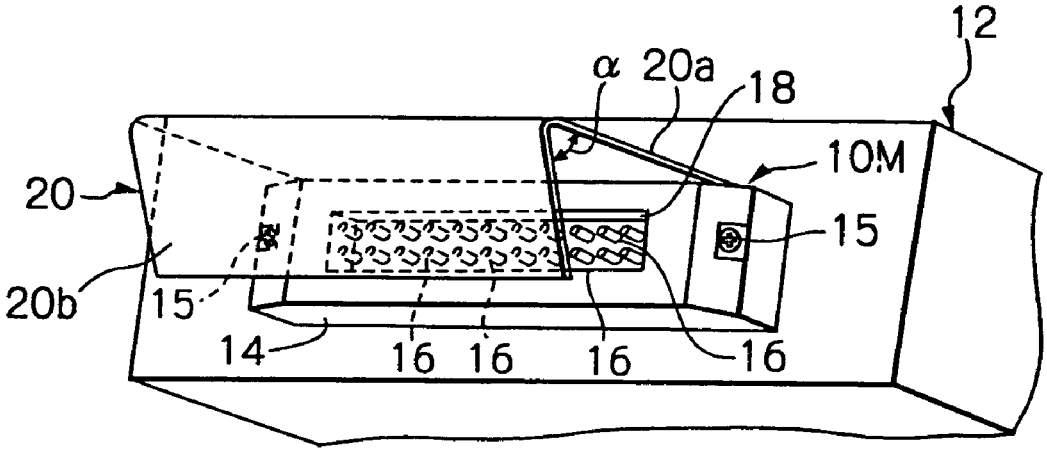
FIG. 1A is a perspective view showing a male type connector half forming a part of a first embodiment of a connector equipped with a dust-proof arrangement according to the present invention, the male type connector half being securely attached to a hard disk drive unit.
Figure 1B:
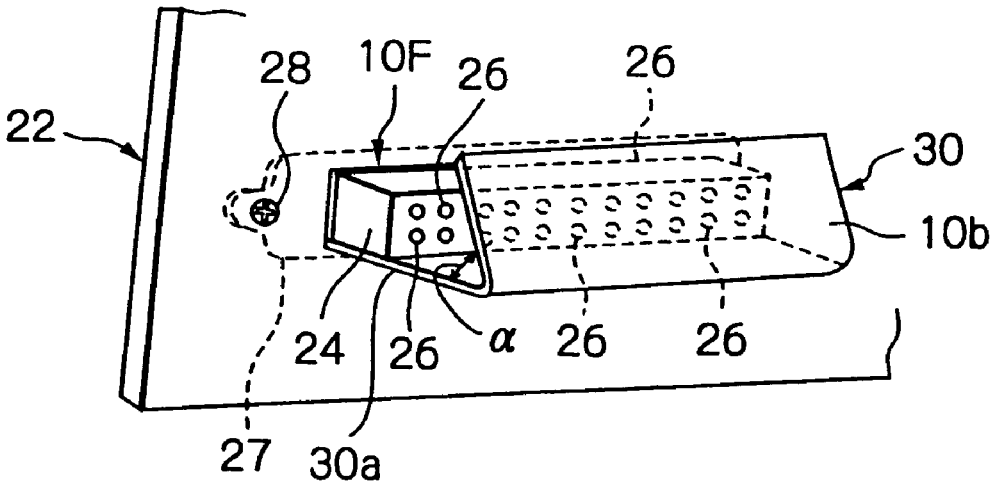

Referring to FIGS. 1A and 1B, a first embodiment of a connector equipped with a dust-proof arrangement according to the present invention is shown, and includes a male type connector half 10M shown in FIG. 1A, and a female type connector half 10F shown in FIG. 1B.

In this first embodiment, the male type connector half 10M is associated with a hard disk drive unit 12. Namely, the connector half 10M includes a connector housing 14 securely attached to a side wall of the hard disk drive unit 12 by a pair of screws 15, and a plurality of pin-like contacts 16 provided in an elongated rectangular recess 18 formed in the connector housing 14. The pin-like contacts 16 are arrayed and planted in a bottom of the rectangular recess 18 so as to form two rows, and are suitably connected to a wiring network of the hard disk driver unit 12.

The male type connector half 10M features a connecting face defined by the array of pin-like contacts 16. In the first embodiment, it is possible to grasp the connecting face as an opening face of the recess 18 of the connector housing 14.

As shown in FIG. 1A, the male type connector half 10M is provided with a dust-proof hood 20 securely attached to an upper side of the connector housing 14, and the dust-proof hood 20 is made of a suitable elastic resin material such as vinyl chloride resin or a suitable rubber material such as silicone rubber.

In the first embodiment, the dust-proof hood 20 is formed as a bent plate-like member which includes a horizontal section 20*a* securely attached to and horizontally extended from the upper side of the connector housing 14, and a slant section 20*b* extended downward from the horizontal section 20*a* and directed toward the connecting face of the connector half 10M, to thereby define an acute angle a between the horizontal and slant sections 20*a* and 20*b*. Thus, the connecting face of the connector half 10M is covered and concealed with the slant section 20*b* of the dust-proof hood 20.

The female type connector half 10F is securely attached to a motherboard 22 provided in an electronic apparatus, such as a computer, a work station or the like. The connector half 10F includes a plug member 24 having a plurality of holes 26, and a fastener frame 27 securely fixed to the plug member 24. For the attachment of the connector half 10F to the motherboard 22, a rectangular opening is formed in the motherboard 22. In particular, the plug member 24 is received in the rectangular opening, and the fastener frame 27 is securely attached to the motherboard 22 by a pair of screws 28 (one of which is not visible in FIG. 1B).

Figure 1C:
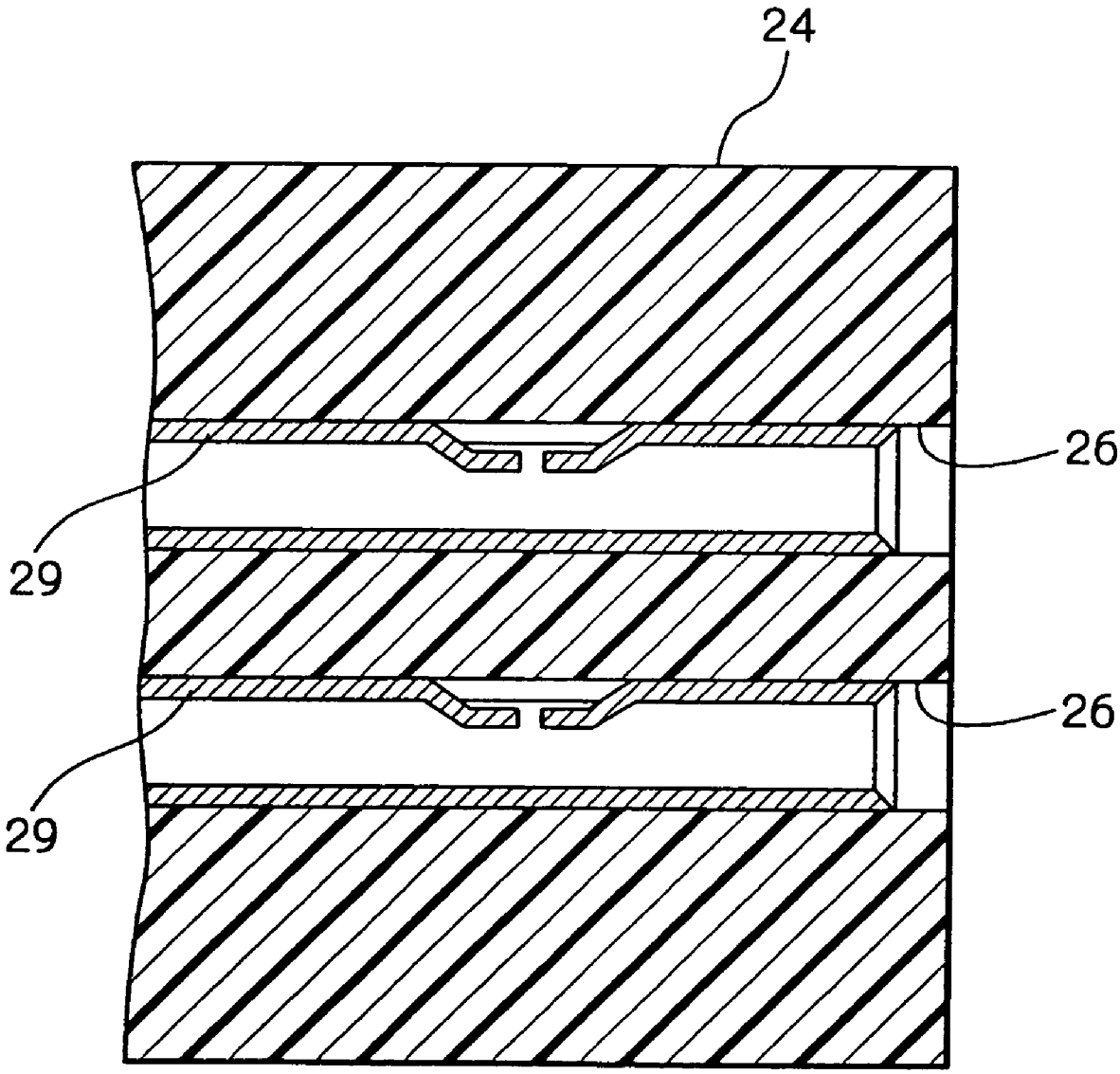
FIG. 1C is a partial cross-sectional view of a plug member of the female type connector half, showing sheath-like contacts provided in holes of the plug member.

The plug member 24 is shaped to be fitted into the rectangular recess 18 of the connector half 10M, and the holes 26 are arrayed so as to form two rows such that the respective pin-like contacts 16 are inserted in the holes 26 when the connector halves 10M and 10F are connected to each other. As shown in FIG. 1C, respective sheath-like contacts 29 are provided in all the holes 26, and are suitably connected to a circuit pattern (not shown) formed on the motherboard 22. In short, when the connection is established between the connector halves 10M and 10F, the pin-like contacts 16 are in electrical contact with the circuit pattern formed on the motherboard 22 through the sheath-like contacts 29 of the connector half 10F.

The female type connector half 10F features a connecting face defined by the array of holes 16. In the first embodiment, it is possible to grasp the connecting face as a front end wall of the plug member 24 in which the array of holes 26 is formed.

As shown in FIG. 1B, the female type connector half 10F is provided with a dust-proof hood 30 securely attached to a lower side of the plug member 24. Similar to the dust-proof hood 20 shown in FIG. 1A, the dust-proof hood 30 is also formed of a suitable elastic resin material such as vinyl chloride resin or a suitable rubber material such as silicone rubber. Preferably, a same elastic material is utilized for both the dust-proof hoods 20 and 30.

Similar to the dust-proof hood 20 shown in FIG. 1A, the dust-proof hood 30 is also formed as a bent plate-like member which includes a horizontal section 30*a* securely attached to and horizontally extended from the lower side of the plug member 24, and a slant section 30*b* extended upward from the horizontal section 30*a* and directed toward the connecting face of the connector half 10F, to thereby define the acute angle a between the horizontal and slant sections 30*a* and 30*b*. Thus, the connecting face of the connector half 10F is covered and concealed with the slant section 30*b* of the dust-proof hood 30.

In the first embodiment, although the acute angle between the sections 20*a* and 20*b* (FIG. 1A) is identical to the acute angle between the sections 30*a* and 30*b* (FIG. 1B), as indicated by the same reference $\alpha$, these acute angles may be different from each other, if necessary. Also, a length of the horizontal section 20*a*, which extends forward from the upper side edge of the connector housing 14, is longer than a length of the horizontal section 30*a* which extends forward from the lower side edge of the plug member 24.

With reference to FIGS. 2A to 2D, a handling manner for connecting the male type connector half 10M to the female type connector half 10F is shown.

Figure 2A:
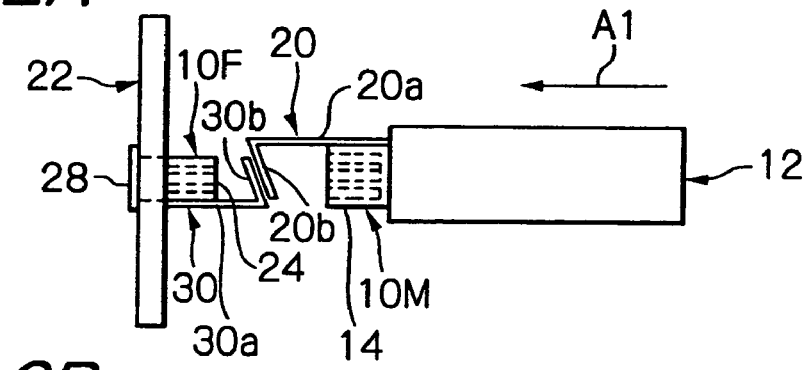
FIG. 2A is an explanatory side view showing an initial stage of a handling manner for connecting the male type connector half to the female type connector half.
Figure 2B:
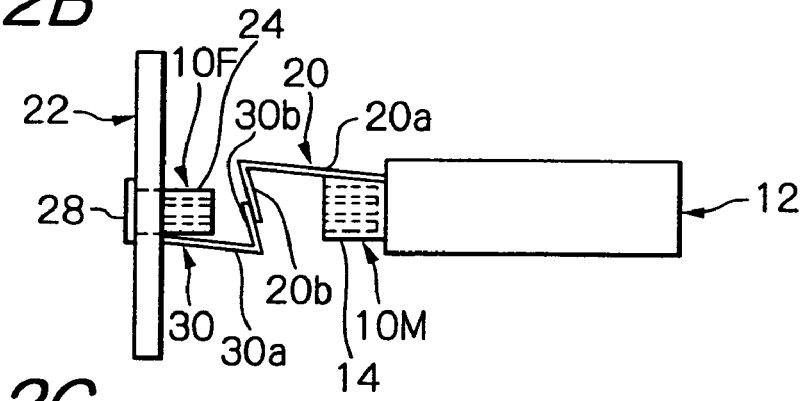
FIG. 2B is an explanatory side view showing a middle stage of the handling manner for connecting the male type connector half to the female type connector half.

First, as shown in FIG. 2A, the male type connector half 10M is positioned relative to the female type connector half 10F such that the connecting faces of the connector halves 10M and 10F are opposed to each other, with the slant sections 20*b* and 30*b* of the dust-proof hoods 20 and 30 being close to each other. Then, the male type connector half 10M is pushed ahead toward the female type connector half 10F in a connecting direction indicated by an arrow A1 in FIG. 2A, such that the slant sections 20*a* and 30*a* of the dust-proof hoods 20 and 30 are engaged with each other, thereby elastically deforming the dust-proof hoods 20 and 30 outward, as shown in FIG. 2B.

Figure 2C:
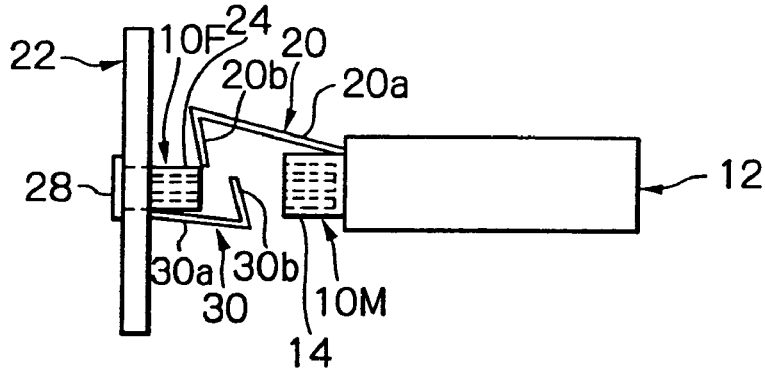
FIG. 2C is an explanatory side view showing another middle stage of the handling manner for connecting the male type connector half to the female type connector half.

When the male type connector half 10M is further pushed ahead in the connecting direction (A1), the slant section 20*a* of the dust-proof hood 20 is disengaged from the slant section 30*a* of the dust-proof hood 30, and is then engaged with the upper side edge of the plug member 24, as shown in FIG. 2C. Thereafter, the slant section 20*a* is disengaged from the upper side edge of the plug member 24 due to the further deformation of the dust-proof hood 20. On the other hand, the slant section 30*a* of the dust-proof hood 30 is engaged with the lower side edge of the connector housing 14, and is then disengaged from the lower side edge of the connector housing 14 due to the further deformation of the dust-proof hood 30.

Figure 2D:
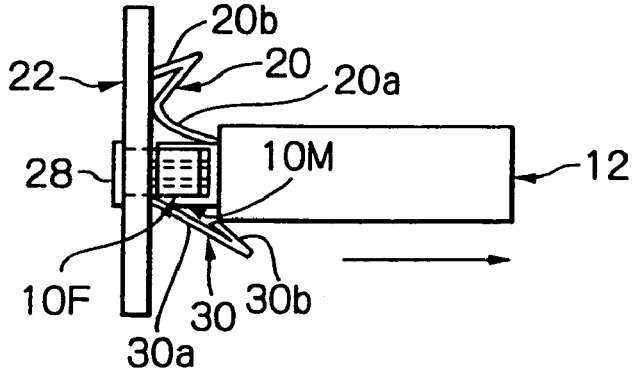
FIG. 2D is an explanatory side view showing a final stage of the handling manner for connecting the male type connector half to the female type connector half.

Thus, the slant sections 20*a* and 30*a* of the dust-proof hoods 20 and 30 are removed out of the space between the connecting faces of the connector halves 10M and 10F, whereby a connection can be finally established between the connector halves 10M and 10F, as shown in FIG. 2D. At this time, the dust-proof hood 20 is elastically deformed and engaged with the motherboard 22, and the dust-proof hood 30 is elastically deformed and engaged with the hard disk drive unit 12, as shown in FIG. 2D.

In short, as is apparent from FIGS. 2A to 2D, the dust-proof hoods 20 and 30 are configured such that they cooperate with each other to be elastically deformed so as not to hinder establishment of the connection between the connector halves 10M and 10F when being connected to each other. Of course, by pulling the male type connector half 10M in a disconnecting direction indicated by an arrow A2 in FIG. 2D, it is possible to easily disconnect the male type connector half 10M from the female connector half 10F.

Although not illustrated, the electronic apparatus, including the hard disk drive unit 12, is provided with a cooling fan which is incorporated in a side wall of a housing of the electronic apparatus, thereby cooling an interior of the housing. Namely, by the cooling fan, an external air containing dust is introduced into the housing to produce air-streams therein, and the introduced air is finally discharged out of the housing. Thus, while the electronic apparatus is operated over a long time, the dust is gradually deposited on interior structures of the electronic apparatus and various electronic parts mounted on the motherboard 22.

In the aforesaid first embodiment, the dust-proof hoods 20 and 30 are arranged based on a situation that the hard disk drive unit 12 is placed in an air-stream parallel to the connecting direction (A1) or disconnecting direction (A2). Namely, the dust-proof arrangement including the hoods 20 and 30 is intended to protect the connector halves 10M and 10F from the dust in the air-stream parallel to the connecting direction (A1) or disconnecting direction (A2), because it is frequently required that the male type connector half 10M is disconnected from and connected to the female type connector half 10F under the operational condition of the electronic apparatus.

For example, when the hard disk drive unit 12 becomes inoperative, it is necessary to replace the hard disk drive unit 12 with a new hard disk drive unit having a male type connector half with a dust-proof hood, substantially identical to the male type connector half 10M with the dust-proof hood 20 shown in FIG. 1A. In this case, the replacement of the new unit for the inoperative unit 12 is frequently performed under the operational condition of the electronic apparatus. Of course, while performing the replacement of the new unit for the inoperative unit 12, a part of the housing of the electronic apparatus is opened to get access to the hard disk drive unit 12.

During the replacement of the new unit for the inoperative unit 12, the deposited dust is liable to be disturbed, and the disturbed dust is taken up by the air-stream parallel to the connecting direction (A1) or disconnecting direction (A2). Thus, when the male type connector half 10M of the inoperative unit 12 is disconnected from the male type connector half 10F, and when the male type connector half of the new unit is connected to the male type connector half 10F, the dust may be easily penetrated into the array of pin-like contacts 16 of the male type connector half 10M of the inoperative or new unit 12 and the array of sheath-like contacts 29 of the female type connector half 10F.

However, according to the dust-proof arrangement including the hoods 20 and 30, it is possible to effectively prevent the penetration of the dust into the array of pin-like contacts 16 of the male type connector half 10M and the array of sheath-like contacts 29 of the female type connector half 10F as stated in detail below.

First, there are two cases wherein the hard disk drive unit 12 is placed in the air-stream parallel to the connecting direction (A1) or disconnecting direction (A2). Namely, one is a first case where the hard disk drive unit 12 is placed in the air-stream produced along the connecting direction (A1), and the other is a second case where the hard disk drive unit 12 is placed in the air-stream produced along the disconnecting direction (A2).

Figure 3:
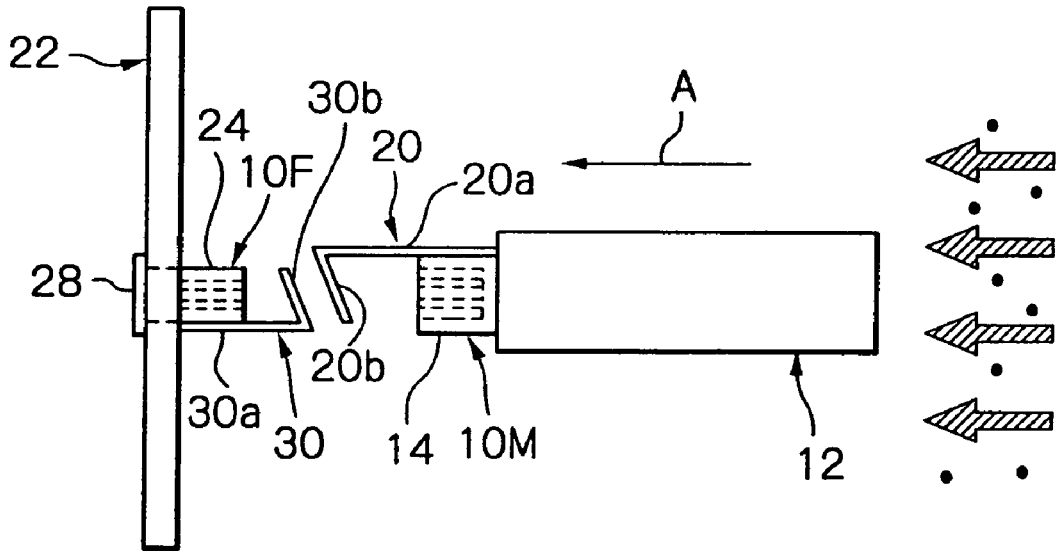
FIG. 3 is an explanatory side view showing a case where the hard disk drive unit is placed in an air-stream produced along a connecting direction of the connector halves in the electronic apparatus.

Referring to FIG. 3, the first case in which the air-stream is represented by four hatched-arrows is shown, and dust particles in the air-stream are represented by small solid circles. As shown in this drawing, when the male type connector half 10M is disconnected from the female type connector half 10F, each of the dust-proof hoods 20 and 30 is released from the elastic deformation so as to return to the original shape due to the elasticity thereof. Then, the hard disk drive unit 12 is brought out of the housing of the electronic apparatus.

Figure 4:
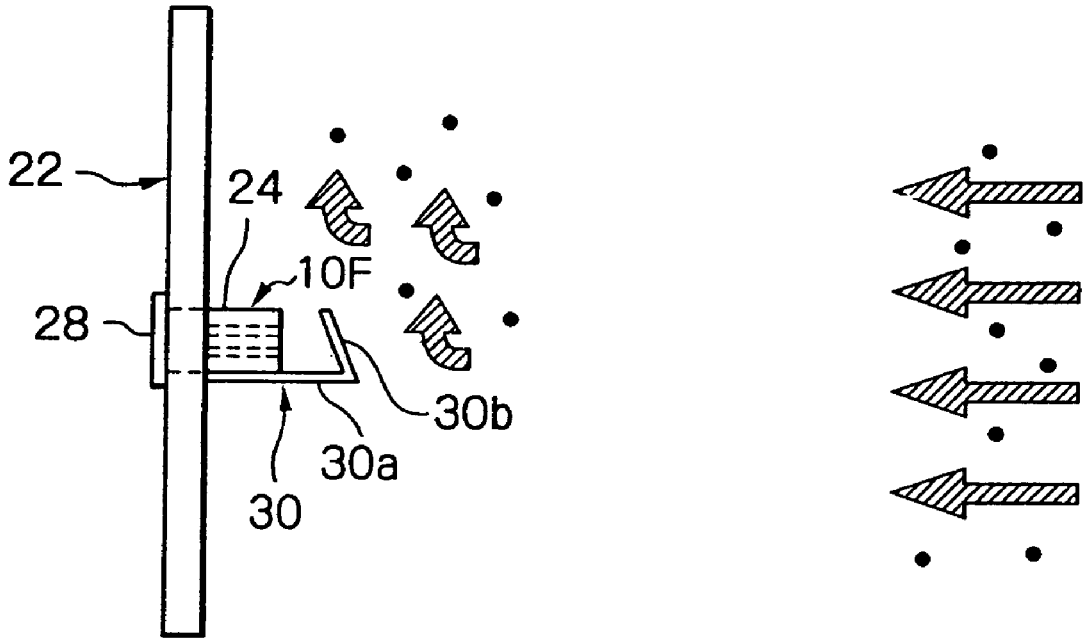
FIG. 4 is an explanatory side view showing how the female type connector half is protected from penetration of dust particles in the air-stream produced along the connecting direction of the connector halves.

When the hard disk drive unit 12 is removed from the position shown in FIG. 3, the air-stream containing the dust particles is directed to the connecting face of the female type connector half 10F, as shown in FIG. 4. Nevertheless, the array of sheath-like contacts 29 of the female type connector half 10F are protected from the penetration of the dust particles, because the air-stream is diverted by the slant section 30*b* of the dust-proof hood 30, as conceptually illustrated in FIG. 4.

Figure 5:
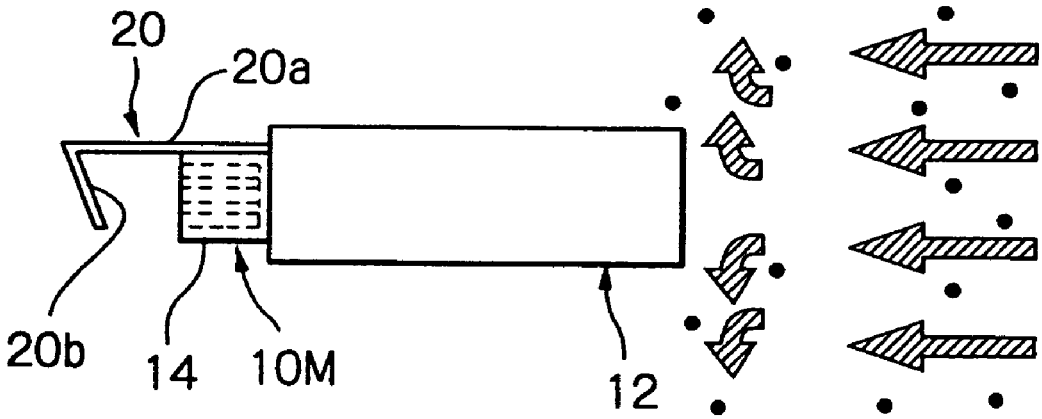
FIG. 5 is an explanatory side view showing how the male type connector half is protected from penetration of dust particles in the air-stream produced along the connecting direction of the connector halves.

During the removal of the male type connector half 10M from the position shown in FIG. 3, the rear end wall of the connector half 10M is merely subjected to the air-stream containing the dust particles, as conceptually illustrated in FIG. 5, and thus the array of pin-like contacts 16 is protected from the penetration of the dust particles.

Figure 6:
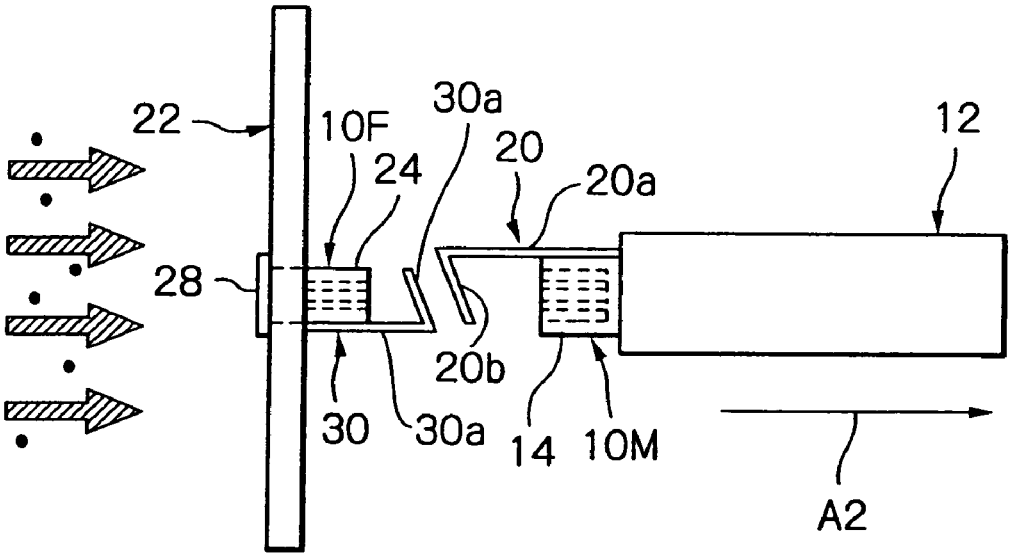
FIG. 6 is an explanatory side view showing a case where the hard disk drive unit is placed in an air-stream produced along a disconnecting direction of the connector halves in the electronic apparatus.

On the other hand, referring to FIG. 6, the aforesaid second case in which the air-stream is represented by four hatched-arrows is shown, and dust particles in the air-stream are represented by small solid circles. Similar to to the first case shown in FIG. 3, when the male type connector half 10M is disconnected from the female type connector half 10F, each of the dust-proof hoods 20 and 30 is released from the elastic deformation so as to return to the original shape due to the elasticity thereof, as shown in FIG. 6.

Figure 7:
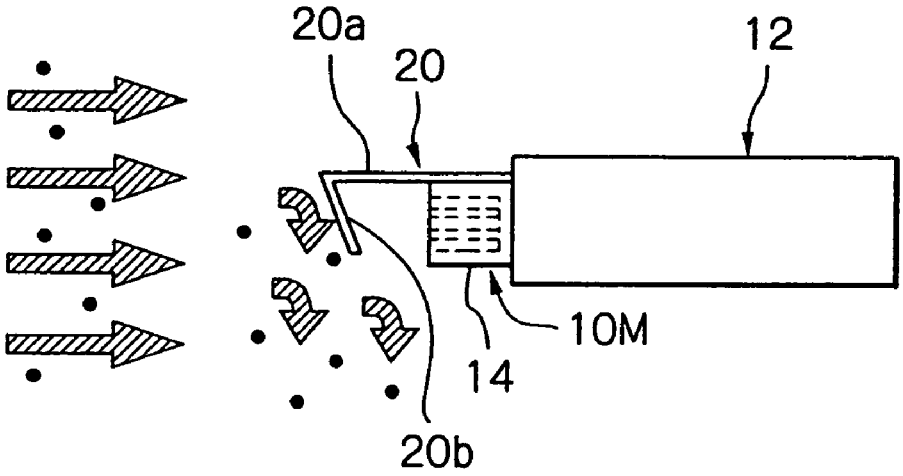
FIG. 7 is an explanatory side view showing how the male type connector half is protected from penetration of dust particles in the air-stream produced along the disconnecting direction of the connector halves.

While the hard disk drive unit 12 is removed from the position shown in FIG. 6, the air-stream containing the dust particles is directed to the connecting face of the male type connector half 10M, as shown in FIG. 7. Nevertheless, the array of pin-like contacts 16 of the female type connector half 10M is protected from the penetration of the dust particles, because the air-stream is diverted by the slant section 20*b* of the dust-proof hood 20, as conceptually illustrated in FIG. 7.

Figure 8:
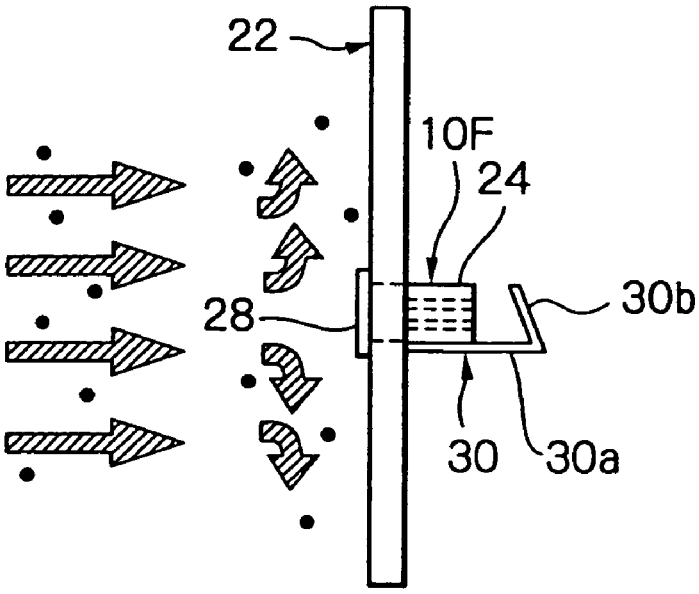
FIG. 8 is an explanatory side view showing how the female type connector half is protected from penetration of dust particles in the air-stream produced along the disconnecting direction of the connector halves.

Also, as conceptually illustrated in FIG. 8, the air-stream is obstructed by the motherboard 22, and thus the array of sheath-like contacts 29 of the female type connector half 10F is protected from the penetration of the dust particles.

After the inoperative hard disk drive unit 12 is removed from the electronic apparatus, the new hard disk drive unit is introduced into the housing of the electronic apparatus, and is then attached to the motherboard 22 by connecting the male type connector half thereof to the female type connector half 10F, but the array of pin-like contacts 16 of the male type connector half of the new hard disk drive unit is also protected from penetration of dust particles in substantially the same manners as explained with reference to FIGS. 5 and 7.

Figure 9A:
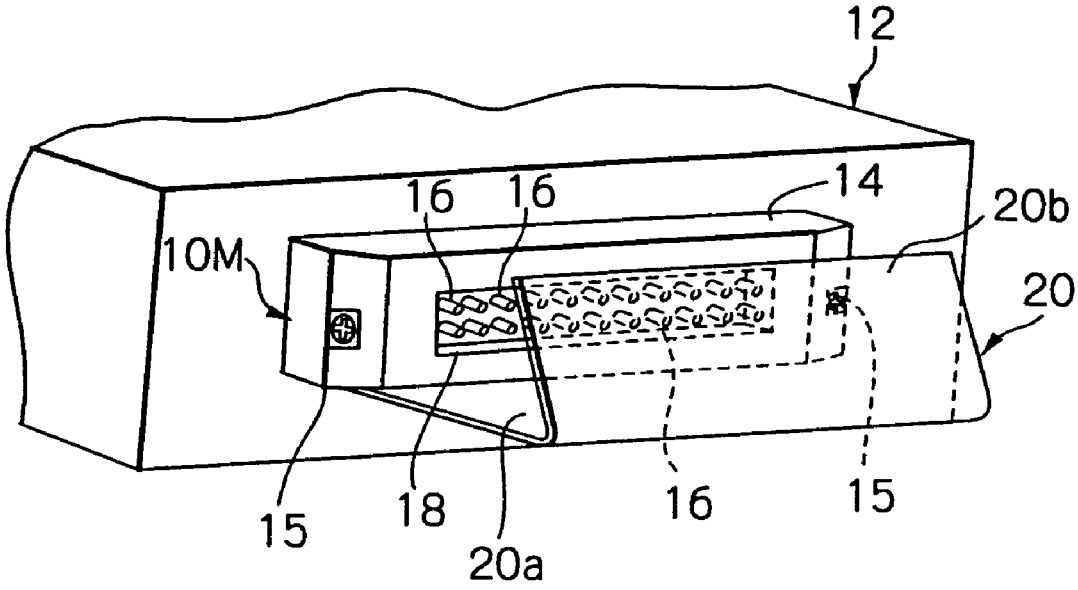
FIG. 9A is a perspective view, corresponding to FIG. 1A, showing a modification of the male type connector half of the first embodiment of the connector equipped with the dust-proof arrangement according to the present invention.
Figure 9B:
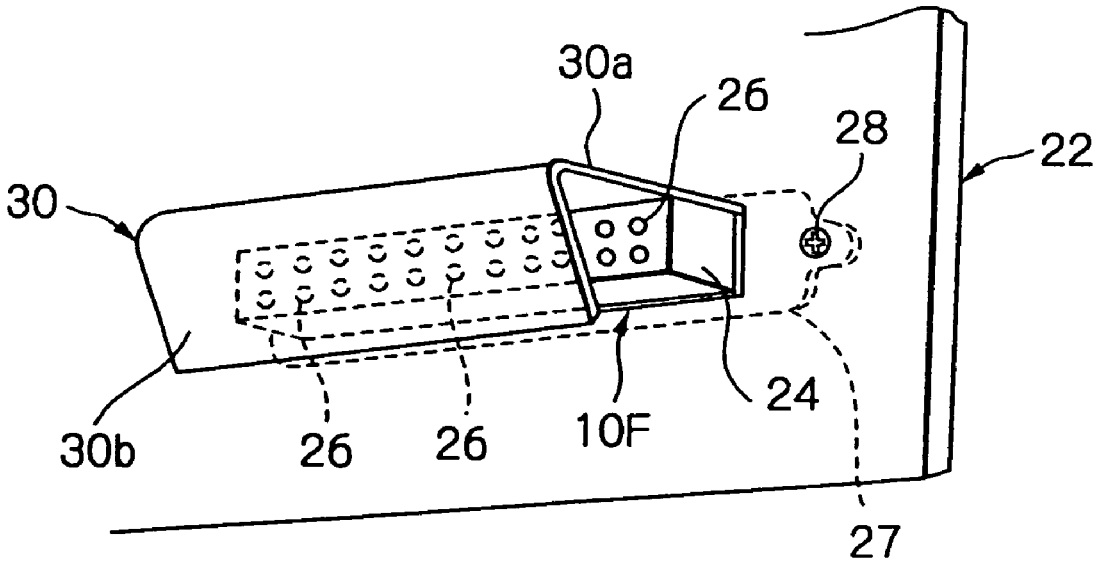
FIG. 9B is a perspective view, corresponding to FIG. 1B, showing a modification of the female type connector half of the first embodiment of the connector equipped with the dust-proof arrangement according to the present invention.

FIGS. 9A and 9B show a modification of the first embodiment of the connector equipped with the dust-proof arrangement according to the present invention. In these drawings, the elements similar to those shown in FIGS. 1A and 1B are indicated by the same references elements.

This modified embodiment is substantially identical to the first embodiment shown in FIGS. 1A and 1B except that the dust-proof hood 20 is securely attached to a lower side of the connector housing 14, and that the dust-proof hood 30 is securely attached to a lower side of the plug member 24, as shown in FIGS. 9A and 9B.

In the modified embodiment, it is intended that the hard disk drive unit 12 is incorporated as an additional hard disk drive unit into the electronic apparatus, if necessary. In this case, the motherboard 22 must be previously provided with the female connector half 10F before the additional hard disk drive unit 12 can be utilized later in the electronic apparatus. Thus, although the female type connector 10F is left as it stands in the housing of the electronic apparatus until the additional hard disk drive unit 12 is needed, the female type connector 10F is protected from the dust deposit because the upper side of the plug member 24 is covered and concealed with the dust-proof hood 30 as shown in FIG. 9B.

Of course, similar to the first embodiment, the array of sheath-like contacts 29 of the female type connector half 10F is protected from the penetration of the dust particles, because the air-stream directed to the connecting face of the female type connector half 10F, is diverted by the slant section 30*b* of the dust-proof hood 30.

Figure 10:
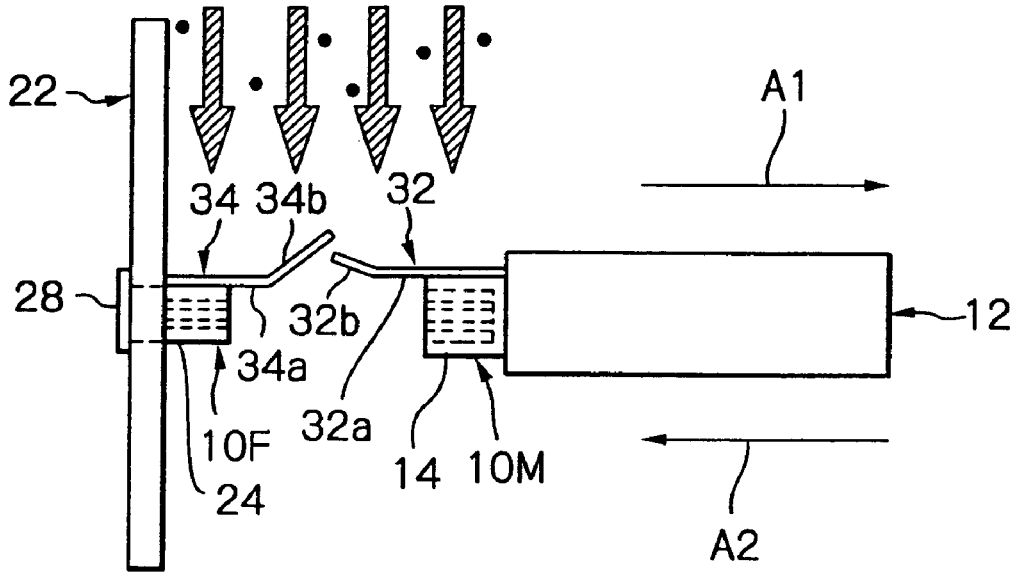
FIG. 10 is a side view showing a second embodiment of the connector equipped with the dust-proof arrangement according to the present invention, a male type connector half being disconnected from a female type connector half.
Figure 11:
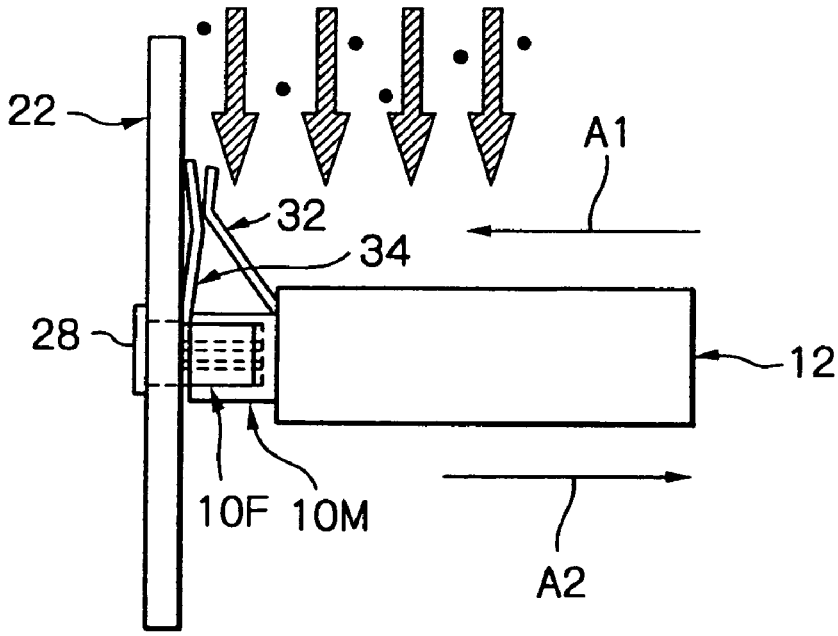
FIG. 11 is a side view, similar to FIG. 10, the male type connector half being completely connected to the female type connector half.

FIGS. 10 and 11 show a second embodiment of the connector equipped with the dust-proof arrangement according to the present invention. In these drawings, the elements similar to those shown in FIGS. 1A and 1B are indicated by the same references elements.

Similar to FIGS. 3 and 6, in FIGS. 10 and 11, an air-stream is represented by four hatched-arrows, and dust particles in the air-stream are represented by small solid circles. In the second embodiment, the hard disk drive unit 12 is placed in an air-stream produced along vertical direction perpendicular to the connecting direction (A1) or disconnecting direction (A2). Namely, the air-stream is directed downward, as shown in FIGS. 10 and 11.

Thus, the male type connector half 10M is provided with a dust-proof hood 32 securely attached to the upper side of the connector housing 14, whereby the array of pin-like contacts 16 of the connector half 10M is protected from penetration of the dust particles. Also, the female type connector half 10F is provided with a dust-proof hood 34 securely attached to the upper side of the plug member 24, whereby the array of sheath-like contacts 29 of the connector half 10F is protected from penetration of the dust particles.

Similar to the first embodiment, the dust-proof hoods 32 and 34 are made of a suitable elastic resin material such as vinyl chloride resin or a suitable rubber material such as silicone rubber. The dust-proof hood 32 is formed as a bent plate-like member which includes a horizontal section 32*a* securely attached to and horizontally extended from the upper side of the connector housing 14, and a slant section 32*b* extended upward from the horizontal section 32*a*, to thereby define an obtuse angle between the horizontal and slant sections 32*a* and 32*b*. Also, the dust-proof hood 34 is formed as a bent plate-like member which includes a horizontal section 34*a* securely attached to and horizontally extended from the upper side of the plug member 24, and a slant section 34*b* extended upward from the horizontal section 34*a*, to thereby define an obtuse angle between the horizontal and slant sections 34*a* and 34*b*.

Accordingly, when the male type connector half 10M is completely connected to the female type connector half 10F, the dust-proof hoods 32 and 34 are engaged with each other and elastically deformed so as not to hinder establishment of the connection between the connector halves 10M and 10F, as shown in FIG. 11.

Figure 12:
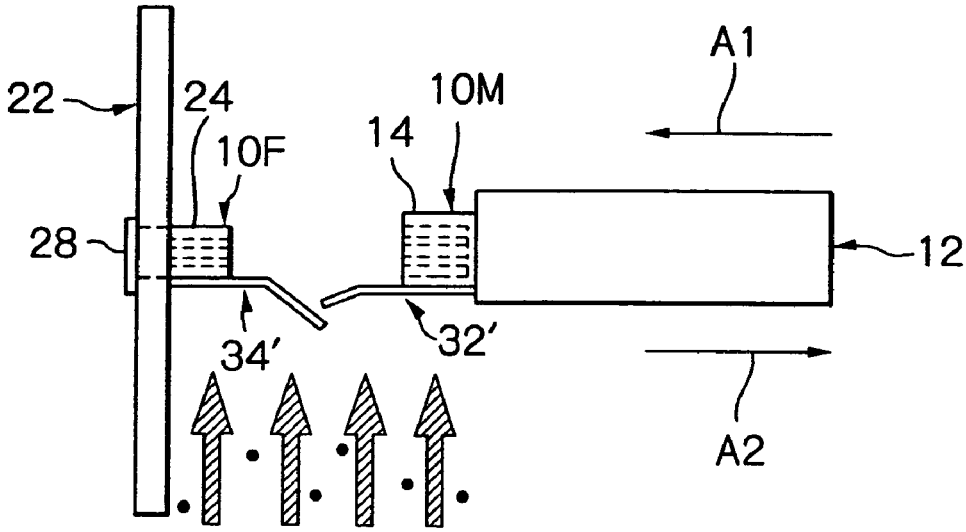
FIG. 12 is a side view showing a third embodiment of the connector equipped with the dust-proof arrangement according to the present invention.

FIG. 12 shows a third embodiment of the connector equipped with the dust-proof arrangement according to the present invention. In this drawing, the elements similar to those shown in FIGS. 1A and 1B are indicated by the same references elements.

Similar to FIGS. 3 and 6, in FIG. 12, an air-stream is represented by four hatched-arrows, and dust particles in the air-stream are represented by small solid circles. Similar to the second embodiment, in the third embodiment, although the hard disk drive unit 12 is placed in an air-stream produced along a vertical direction perpendicular to the connecting direction (A1) or disconnecting direction (A2), the air-stream is directed upward, as shown in FIG. 12.

Thus, the male type connector half 10M is provided with a dust-proof hood 32' securely attached to the lower side of the connector housing 14, whereby the array of pin-like contacts 16 of the connector half 10M is protected from penetration of the dust particles. Also, the female type connector half 10F is provided with a dust-proof hood 34' securely attached to the lower side of the plug member 24, whereby the array of sheath-like contacts 29 of the connector half 10F is protected from penetration of the dust particles.

Similar to the first embodiment, the dust-proof hoods 32' and 34' are made of a suitable elastic resin material such as vinyl chloride resin or a suitable rubber material such as silicone rubber. As is apparent from a comparison of FIG. 12 with FIGS. 10 and 11, the respective dust-proof hoods 32' and 43' are substantially identical to the dust-proof hoods 32 and 34 shown in FIGS. 10 and 11. Thus, when the male type connector half 10M is completely connected to the female type connector half 10F, the dust-proof hoods 32' and 34' are engaged with each other and elastically deformed so as not to hinder establishment of the connection between the connector halves 10M and 10F, as shown in FIG. 12.

Figure 13:
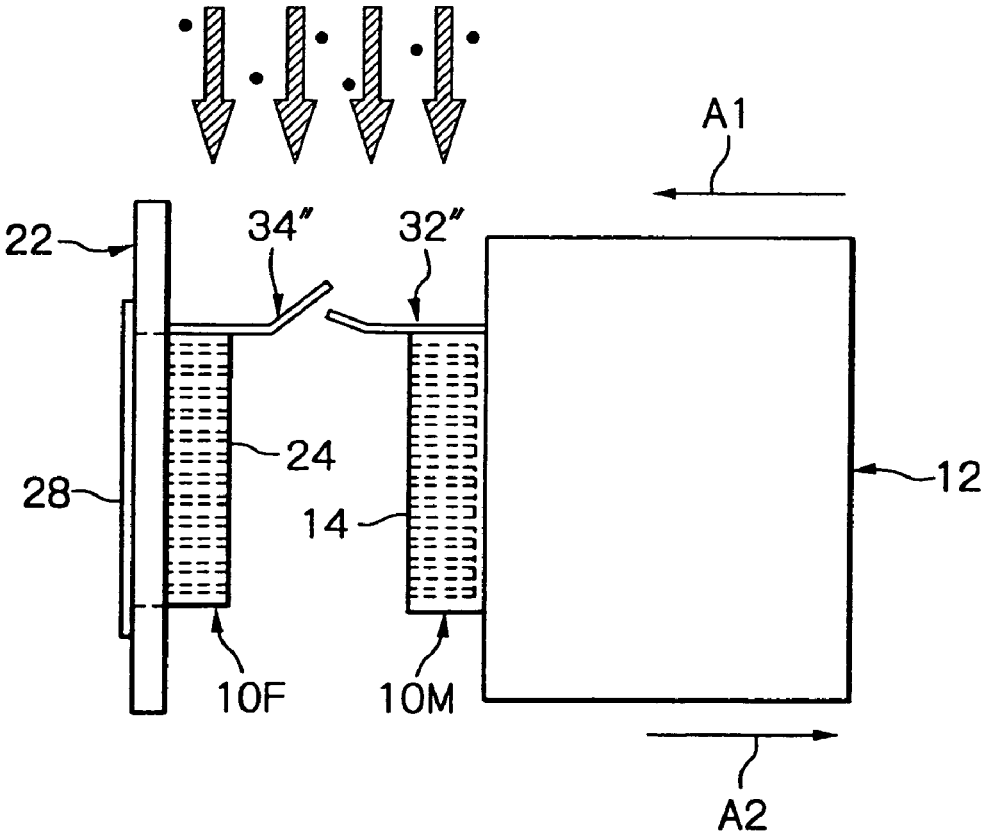
FIG. 13 is a plan view showing a fourth embodiment of the connector equipped with the dust-proof arrangement according to the present invention.

FIG. 13 shows a forth embodiment of the connector equipped with the dust-proof arrangement according to the present invention. In this drawing, the elements similar to those shown in FIGS. 1A and 1B are indicated by the same references elements.

Similar to FIGS. 3 and 6, in FIG. 13, an air-stream is represented by four hatched-arrows, and dust particles in the air-stream are represented by small solid circles. In the forth embodiment, the hard disk drive unit 12 is placed in an air-stream produced along a horizontal direction perpendicular to the connecting direction (A1) or disconnecting direction (A2).

Thus, the male type connector half 10M is provided with a dust-proof hood 32" securely attached to a side of the connector housing 14 which is directly subjected to the air-stream, whereby the array of pin-like contacts 16 of the connector half 10M is protected from penetration of the dust particles. Also, the female type connector half 10F is provided with a dust-proof hood 34" securely attached to a side of the plug member 24 which is directly subjected to the air-stream, whereby the array of sheath-like contacts 29 of the connector half 10F is protected from penetration of the dust particles.

Similar to the first embodiment, the dust-proof hoods 32" and 34" are made of a suitable elastic resin material such as vinyl chloride resin or a suitable rubber material such as silicone rubber. As is apparent from a comparison of FIG. 13 with FIGS. 10 and 11, the respective dust-proof hoods 32" and 43" are also substantially identical to the dust-proof hoods 32 and 34 shown in FIGS. 10 and 11. Thus, when the male type connector half 10M is completely connected to the female type connector half 10F, the dust-proof hoods 32" and 34" are engaged with each other and elastically deformed so as not to hinder establishment of the connection between the connector halves 10M and 10F, as shown in FIG. 13.

Figure 14:
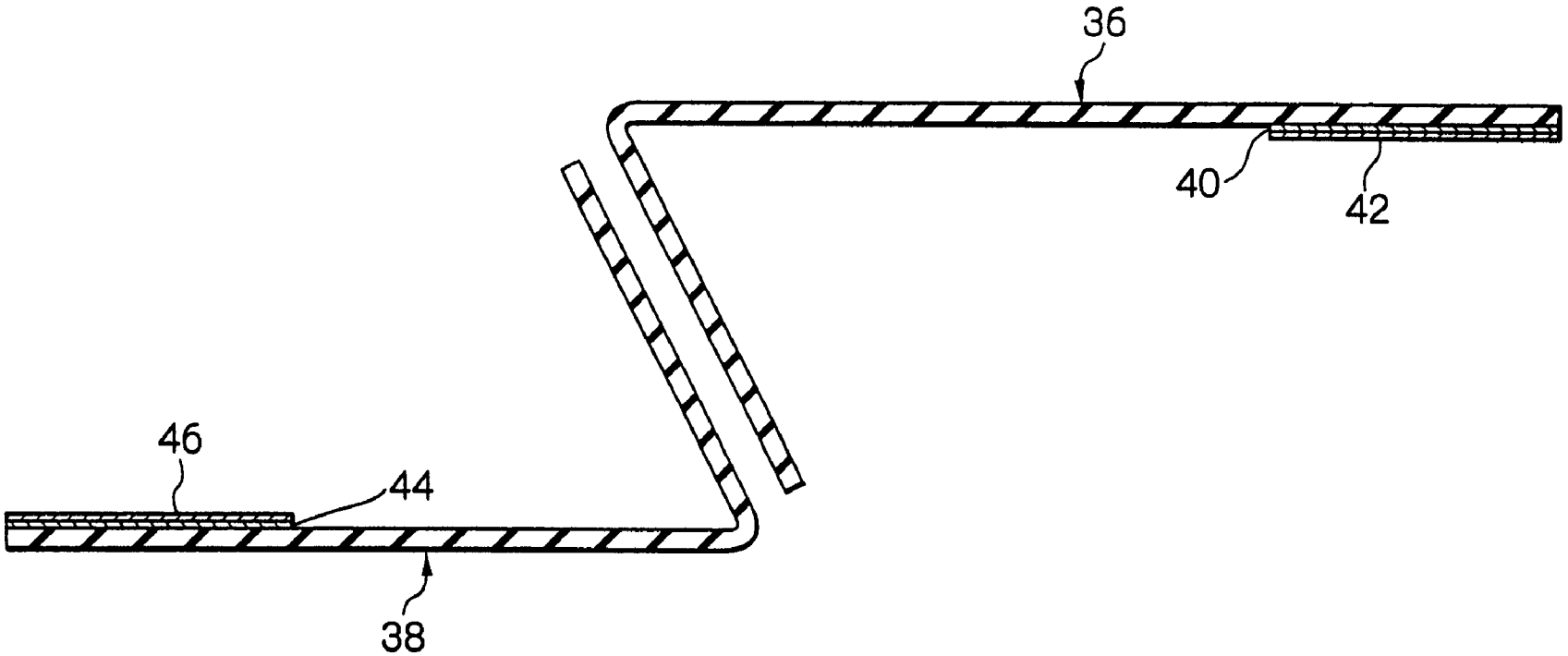
FIG. 14 is a cross-sectional view showing an embodiment of a set of dust-proof hoods which may be utilized in an existing connector including a male type connector half and a female type connector half.

FIG. 14 shows an embodiment of a set of dust-proof hoods 36 and 38 which are constituted so as to be conveniently utilized in an existing connector including a male type connector half (10M) and a female type connector half (10F), as shown in FIGS. 1A and 1B.

Both the dust-proof hoods 36 and 38 are made of a suitable rubber material, such as silicon rubber, exhibiting an appropriate hardness. The dust-proof hood 36 has an adhesive layer 40 formed on a root section thereof, and a peel-off sheet 42 applied to the adhesive layer 40. Similarly, the dust-proof hood has an adhesive layer 44 formed on a root section thereof, and a peel-off sheet 46 applied to the adhesive layer 44. Thus, it is possible to adhesively attach the respective dust-proof hoods 36 and 38 to the connector halves (10M and 10F) of the existing connector with the adhesive layer 40, from which the peel-off is removed.

Figure 15:
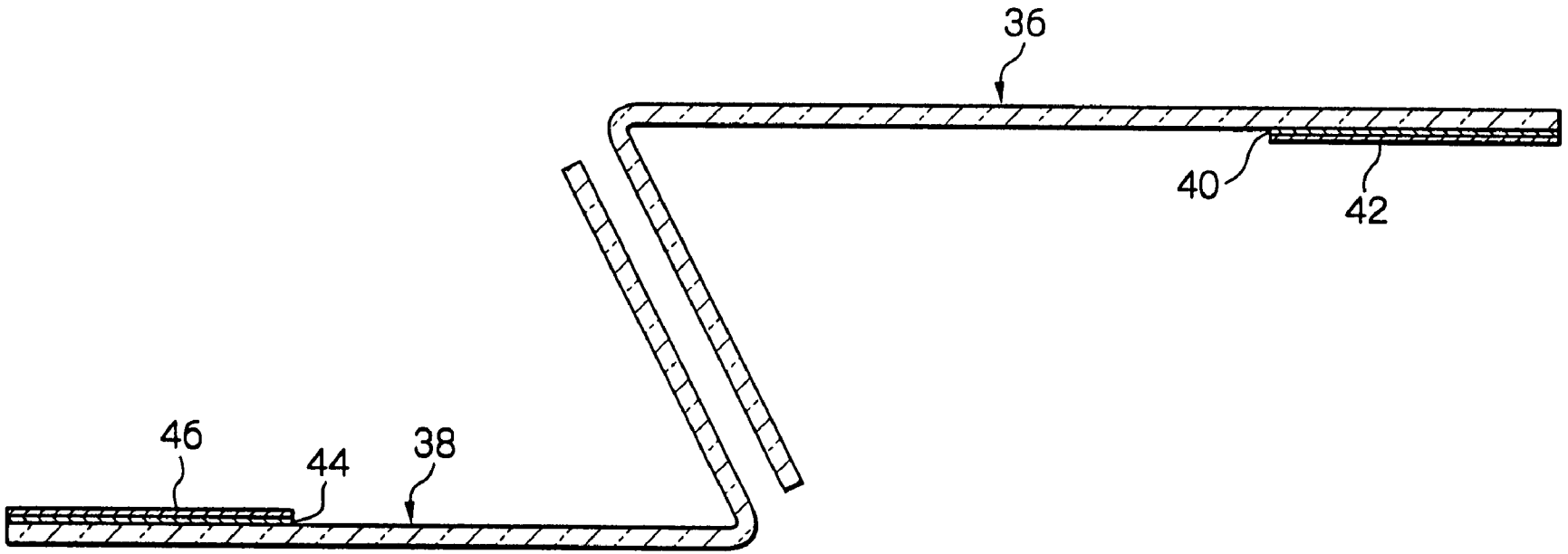
FIG. 15 is a cross-sectional view, similar to FIG. 14, showing a modification of the embodiment of the set of dust-proof hoods.

FIG. 15 shows a modification of the embodiment of the set of dust-proof hoods 36 and 38 shown in FIG. 14. In this modified embodiment, the dust-proof hoods 36 and 38 are made of a suitable transparent elastic resin suitable. In this case, it is possible to easily and quickly establish the connection between the connector halves, because the connecting faces of the connector halves are visible through the transparent dust-proof hoods 36 and 38.

In all the aforesaid embodiments, the dust-proof hoods (20 and 30; 32' and 34'; 32" and 34"; and 36 and 38) may have a static electricity, and the static electricity of each dust-proof hood exerts a negative influence on transmission of signals in the connector. For example, the transmission of the signal is made to be unstable because of the static electricity of each dust-proof hood.

In order to eliminate the static electricity from each dust-proof hood, it is necessary to make each dust-proof electrically conductive. To this end, the dust-proof hoods may be made of a suitable conductive rubber material, such as silicone rubber, containing metal powder, carbon powder or the like.

Figure 16:
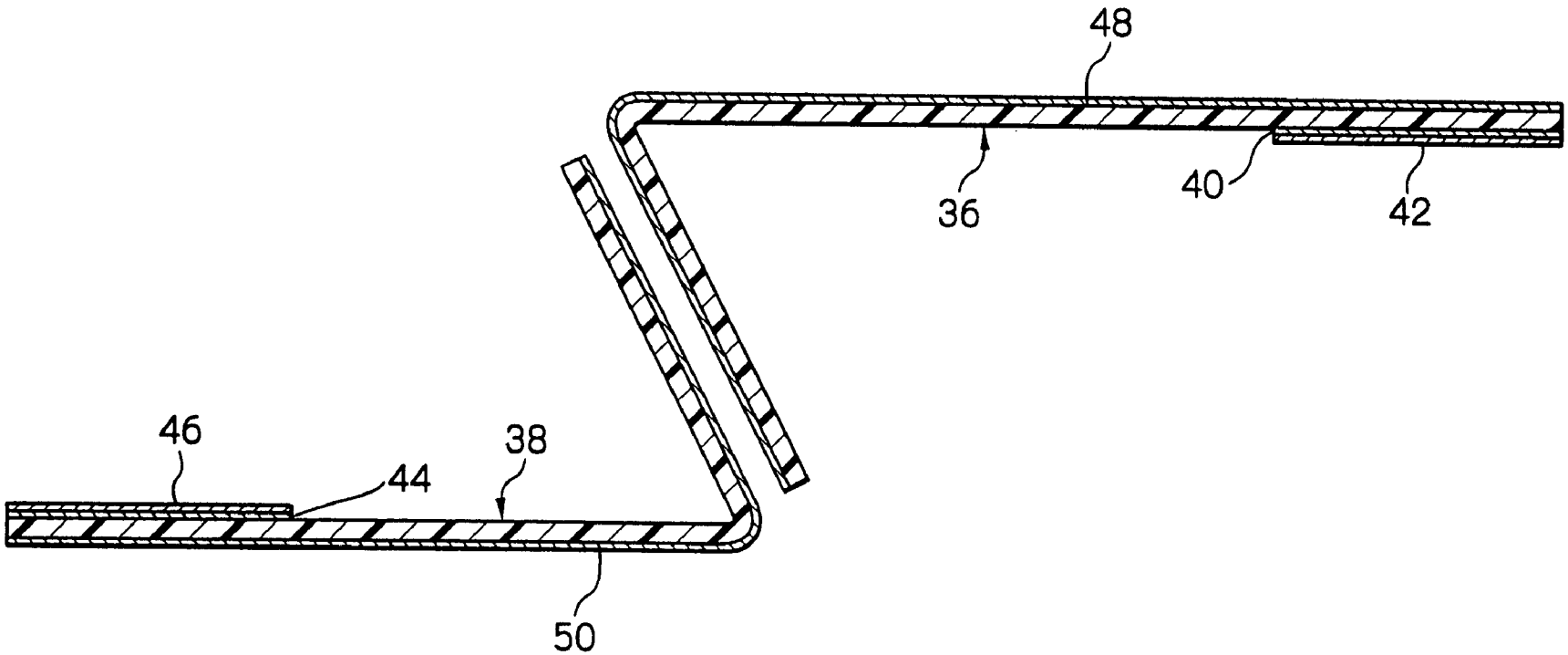
FIG. 16 is a cross-sectional view, similar to FIG. 14, showing another modification of the embodiment of the set of dust-proof hoods.

On the other hand, when the dust-proof hoods are made of a suitable elastic resin material such as vinyl chloride resin, it is possible to form an electrically-conductive film layer on each dust-proof hood, as representatively shown in FIG. 16. Namely, as the electrically-conductive film layer, suitable metal film layers 48 and 50 are formed on the dust-proof hoods 36 and 38, respectively, and it is possible to achieve the formation of the metal film layers by, for example, spattering.

Of course, when a connector half equipped with the conductive dust-proof hood is assembled in an electronic unit or a motherboard, the conductive dust-proof hood is grounded to a metal frame of an electronic apparatus.

In the above-mentioned embodiments, although the present invention is applied to a hard disk drive unit, it should be understood that the present invention may be embodied in another unit, such as an additional memory board, a wiring-board unit having various electronic components mounted thereon, and so on.

Finally, it will be understood by those skilled in the art that the foregoing description is of preferred embodiments of the devices, and that various changes and modifications may be made to the present invention without departing from the spirit and scope thereof.

What is claimed is:

1. A set of first and second dust-proof hoods for a connector comprising a first type connector half having a first array of electrical contacts, and a second type connector half having a second array of electrical contacts, said connector being utilized in an electronic unit detachably provided in an electronic apparatus in which an air-stream is produced in said electronic apparatus to cool an interior thereof, said set comprising:

a first dust-proof hood adapted to attach to said first type connector half to protect said first array of electrical contacts from dust in the air-stream, and a second dust-proof hood adapted to attach to said second type connector half to protect said second array of electrical contacts from dust in the air-stream, wherein said first and second dust-proof hoods cooperate with each other to elastically deform so as not to hinder establishment of a connection between said first array of electrical contacts and said second array of electrical contacts when said first type connector half and said second type connector half are connected to each other.

2. A set of first and second dust-proof hoods as set forth in claim 1, wherein each of said first and second dust-proof hoods has an adhesive layer for the attachment to a corresponding connector half.

3. A set of first and second dust-proof hoods as set forth in claim 2, wherein said adhesive layer has a peel-off sheet applied thereto.

4. A set of first and second dust-proof hoods as set forth in claim 1, wherein the air-stream is produced along a direction parallel to a connecting direction in which said first type connector half and said second type connector half are connected to each other, and each of said first and second dust-proof hoods is formed as a bent plate-like member including a section extended in parallel to said connecting direction, and a slant section directed toward a corresponding array of electrical contacts to define an acute angle between said sections, whereby the corresponding array of electrical contacts is covered and concealed with said slant section, resulting in the protection of the corresponding array of electrical contacts from the penetration of dust in the air-stream.

5. A set of first and second dust-proof hoods as set forth in claim 1, wherein the air-stream is produced along a direction perpendicular to a connecting direction in which said first type connector half and said second type connector half are connected to each other, and each of said first and second dust-proof hoods is formed as a bent plate-like member including a section extended in of said connecting direction, and a slant section directed to define an obtuse angle between said sections, thereby blocking the air-stream, resulting in the protection of the corresponding array of electrical contacts from the penetration of dust in the air-stream.

6. A set of first and second dust-proof hoods as set forth in claim 1, wherein each of said first and second dust-proof hoods is made of a suitable rubber material.

7. A set of first and second dust-proof hoods as set forth in claim 1, wherein each of said first and second dust-proof hoods is made of a suitable electrically conductive rubber material, and is grounded to an electrically conductive frame of said electronic apparatus.

8. A set of first and second dust-proof hoods as set forth in claim 1, wherein each of said first and second dust-proof hoods is made of a suitable transparent elastic resin material.

9. A set of first and second dust-proof hoods as set forth in claim 1, wherein each of said first and second dust-proof hoods is made of a suitable elastic resin material, and is provided with an electrically conductive film layer formed thereon, and said electrically conductive film layer is grounded to an electrically conductive frame of said electronic apparatus.

* * * * *